US008322433B2

(12) United States Patent
Bedouet et al.

(10) Patent No.: US 8,322,433 B2
(45) Date of Patent: Dec. 4, 2012

(54) WIRED SLIP JOINT

(75) Inventors: Sylvain Bedouet, Houston, TX (US); Erik Quam, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 73 days.

(21) Appl. No.: 12/791,830

(22) Filed: Jun. 1, 2010

(65) Prior Publication Data

US 2010/0300698 A1 Dec. 2, 2010

Related U.S. Application Data

(60) Provisional application No. 61/182,977, filed on Jun. 1, 2009.

(51) Int. Cl.
*E21B 47/00* (2012.01)
*E21B 17/07* (2006.01)

(52) U.S. Cl. ... 166/345; 166/339; 166/355; 166/250.01; 285/145.1; 285/302

(58) Field of Classification Search ..... 166/345, 166/338, 339, 344, 351, 352, 355, 358, 367, 166/250.01, 255.1, 381, 66; 285/145.1, 298, 285/302
See application file for complete search history.

(56) References Cited

U.S. PATENT DOCUMENTS 2,852,231 A * 9/1958 Le Bus, Sr. ..... 464/18
2,918,259 A * 12/1959 Le Bus, Sr. ..... 175/321
3,876,000 A * 4/1975 Nutter ..... 166/106
4,524,832 A * 6/1985 Roche et al. ..... 166/347
4,597,447 A * 7/1986 Roche et al. ..... 166/347
4,626,135 A * 12/1986 Roche ..... 405/224.2
4,860,581 A 8/1989 Zimmerman et al.
5,024,469 A * 6/1991 Aitken et al. ..... 285/302
5,433,276 A 7/1995 Martain
6,148,922 A * 11/2000 Vatne ..... 166/367
6,173,781 B1 * 1/2001 Milne et al. ..... 166/355
6,641,434 B2 * 11/2003 Boyle et al. ..... 439/577
6,655,460 B2 * 12/2003 Bailey et al. ..... 166/301
6,817,422 B2 * 11/2004 Jordan ..... 166/381
7,237,613 B2 * 7/2007 Radi et al. ..... 166/359
7,274,989 B2 * 9/2007 Hopper ..... 702/6
7,334,967 B2 * 2/2008 Blakseth et al. ..... 405/224.2
7,658,228 B2 * 2/2010 Moksvold ..... 166/345
7,686,544 B2 * 3/2010 Blakseth et al. ..... 405/224.2
7,699,109 B2 * 4/2010 May et al. ..... 166/367

(Continued)

OTHER PUBLICATIONS

Alden, Mark et al., Advancing Downhole Conveyance, Oilfield Review, Autumn 2004, pp. 30-43.

*Primary Examiner* — Matthew Buck
(74) *Attorney, Agent, or Firm* — John Vereb

(57) ABSTRACT

Embodiments of the invention disclose systems, apparatuses, and methods of measurement performed by pipe conveyed tools. In an embodiment, a system for evaluation of a well bore includes a drill string assembly comprising a plurality of pipe joints, a wired slip joint coupled to the plurality of drill pipe, the slip joint movable from a retracted position to an extended position to compensate for changes in length of the drill string, the extended position having a length greater than the retracted position; a sensor positioned in the slip joint, wherein the sensor detects a change in length of the slip joint and generates a signal representative of a position of the slip joint, and a communication system to transmit the signal from the slip joint to a surface processor.

19 Claims, 10 Drawing Sheets

U.S. PATENT DOCUMENTS

2004/0150533 A1* 8/2004 Hall et al. ..... 340/854.4
2006/0225926 A1* 10/2006 Madhavan et al. ..... 175/320
2006/0283606 A1 12/2006 Partouche et al.
2007/0029112 A1* 2/2007 Li et al. ..... 175/26
2007/0159351 A1* 7/2007 Madhavan et al. ..... 340/855.1
2008/0053652 A1* 3/2008 Corre et al. ..... 166/179
2008/0271896 A1* 11/2008 Inderberg et al. ..... 166/355
2009/0025926 A1 1/2009 Briquet et al.

* cited by examiner

WIRED SLIP JOINT

CROSS-REFERENCE TO RELATED APPLICATIONS

This application claims benefit of U.S. Provisional Patent Application Ser. No. 61/182,977, entitled "Wired Slip Joint," filed Jun. 1, 2009, which is herein incorporated by reference in its entirety.

BACKGROUND OF THE INVENTION

Background Art

Well logging instruments are devices configured to move through a wellbore drilled through subsurface formations. The devices include one or more sensors and other devices that measure various properties of the formations and/or perform certain mechanical acts on the formations, such as drilling or percussively obtaining samples of the formations, and withdrawing samples of connate fluid from the formations. Measurements of the properties of the formations made by the sensors in some cases may be recorded with respect to the instrument axial position (depth) within the wellbore as the instrument is moved along the wellbore. Such recording is referred to as a "well log." Other wellbore measuring instruments include devices that make so called "station" measurements, wherein the instrument is disposed at a selected, fixed position in the wellbore, and sensors in the instrument make measurements of selected parameters (e.g., pressure and temperature) and/or samples of the formation are withdrawn into the instrument. For example, station measurements may include measurements performed by a downhole tool, relatively immobile with respect to the formation for a duration of time, such as approximately one hour or more. The samples may include plug cores or drilled cores of the formation proximate the wellbore wall, and/or fluid withdrawn from the pore spaces of porous formations.

Well logging instruments may be conveyed along the wellbore by extending and withdrawing an armored electrical cable ("wireline"), wherein the instruments are coupled to the end of the wireline. Such conveyance relies on gravity to move the instruments into the wellbore. Extending and withdrawing the wireline is also performed using a winch or similar spooling device. "Logging while drilling" ("LWD") instruments may also be used in certain circumstances. Such circumstances include, for example, expensive drilling operations, where the time needed to suspend drilling operations in order to make the wellbore accessible to wireline instruments would make the cost of such access prohibitive, and wellbores having a substantial lateral displacement from the surface location of the well. Such circumstances also include large lateral displacement of the wellbore particularly where long wellbore segments have high inclination (deviation from vertical). In such cases, gravity is not able to overcome friction between the instruments and the wellbore wall, thus making wireline conveyance impracticable. LWD instrumentation has proven technically and economically successful under the appropriate conditions. LWD instrument operation may be described as using instruments disposed in one or more "drill collars" which are thick-walled segments of pipe having threaded connections at the longitudinal ends thereof. The collars are coupled into a drill "string", which is a continuous length of pipe made by assembling sections ("joints") of pipe together end to end. The pipe string is inserted into a wellbore, typically with a drill bit at its lower longitudinal end. The drill string assembly is lowered into the wellbore by a drilling unit or "rig" having suitable hoisting devices thereon. The drill string may also be rotated by equipment on the drilling unit and/or by a hydraulically operated motor in the drill string. The rotation and longitudinal insertion of the pipe string causes the bit to drill the subsurface formations, thus lengthening the wellbore. As the collars of the LWD instruments move past the drilled formations, sensors therein make measurements of selected properties of the formations.

When station measurements are made using an armored electrical cable ("wireline") conveyance, the relatively high bandwidth of the wireline makes possible substantially instantaneous ("real time") communication of commands from the surface to the instrument in the wellbore, and similar speed of communication of data from the instruments in the wellbore to the surface. An instrument operator may make certain operating decisions based on interpretation of such data in real time. LWD systems in general use various forms of modulation of drilling fluid flow as such fluid being pumped through a longitudinal conduit inside the pipe. Such communication is effective, but at best is capable of only several bits per second of transmission speed. Because of the relatively low bandwidth of drilling fluid modulation telemetry, many of the functions that take place in certain station measurements, particularly formation sample taking, may not show any errors until well into the sample taking. In LWD instrumentation, a processor in the LWD instrument can be programmed to automatically cause the instrument to perform certain functions, such as deployment of probes and operation of internal fluid flow line valves, to cause the station measurements to be made. Such automation leaves open the possibility that some of the station measurements are unsuccessful, and determination of such fact may be delayed until after a station measurement procedure is substantially completed. In such cases automated procedures may result in considerable loss of valuable drilling unit time.

More recently, a type of drill pipe has been developed that includes an electromagnetic signal communication channel, commonly referred to as "wired drill pipe". See, for example, U.S. Pat. No. 6,641,434 issued to Boyle et al. and assigned to the assignee of the present invention. Such drill pipe has in particular provided substantially increased signal telemetry speed for use with LWD instruments over conventional LWD signal telemetry, which, as explained above, typically is performed by drilling fluid flow modulation, or by very low frequency electromagnetic signal transmission.

Wireline conveyable well logging instruments using drill pipe as the conveyance may also be used. Such conveyance is used where gravity alone is insufficient to move the logging instruments along the wellbore. Such conveyance has particular application in inclined wellbores, i.e. wellbores that deviate from vertical. See, for example, U.S. Pat. No. 5,433,276 issued to Martain et al. In some cases, the wireline instrument string can be coupled to the drill string using a compressible member. Such compressible members may reduce the possibility of damage to the instrument string by compression when the drill string is moved into the wellbore. It is desirable to be able to control the operation of such compressible members during the movement of the drill string and while the drill string is stationary.

What is needed is a method for operating station measurement devices to enable more efficient station measurement operations. For example, changes of pipe length during station measurements as well as signal and/or power transmission between downhole tools and the surface during station measurements need to be addressed.

DETAILED DESCRIPTION

Figure 1A:
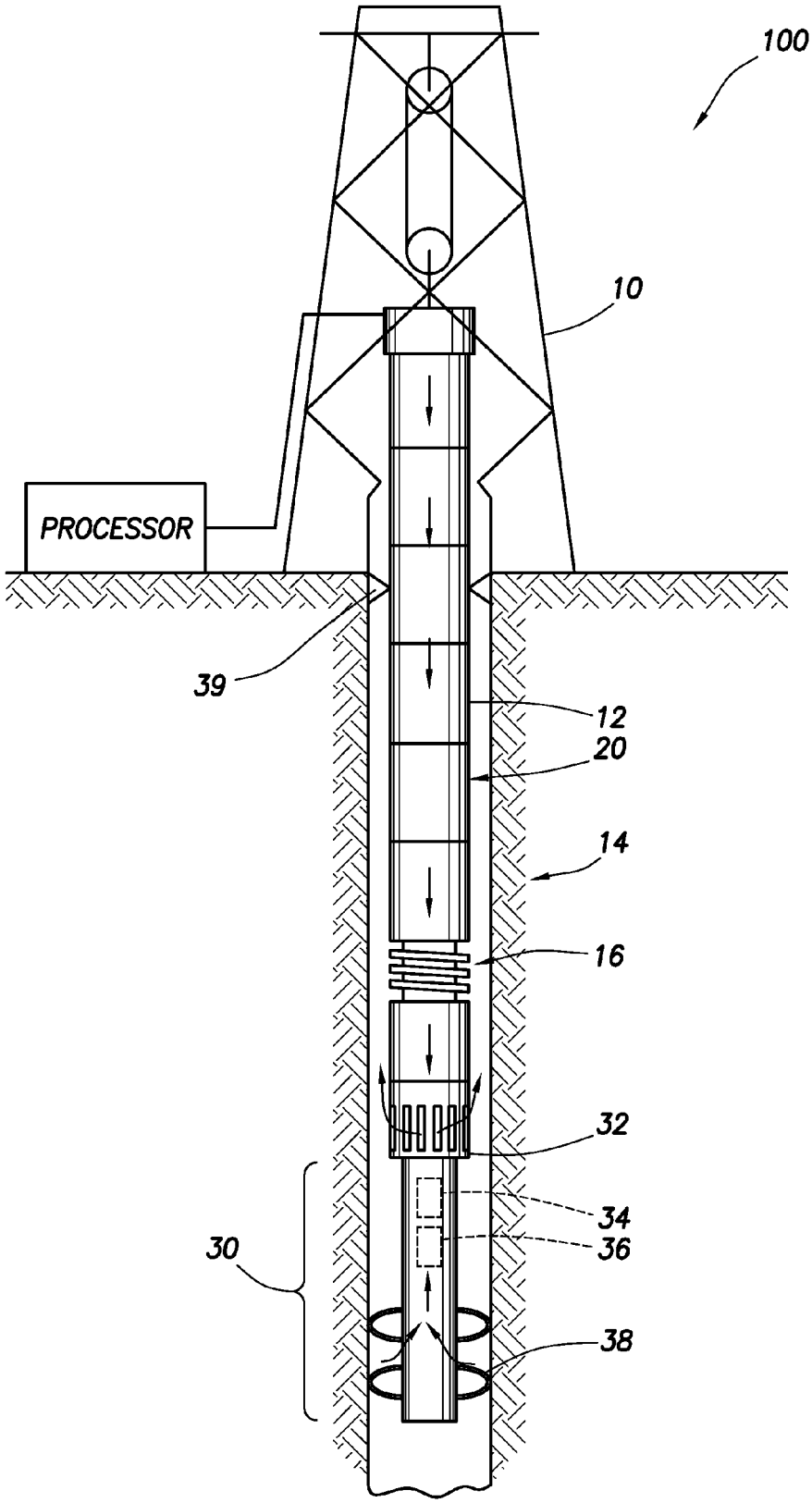
FIG. 1A illustrates an example well site system in an embodiment of the present invention.
Figure 1B:
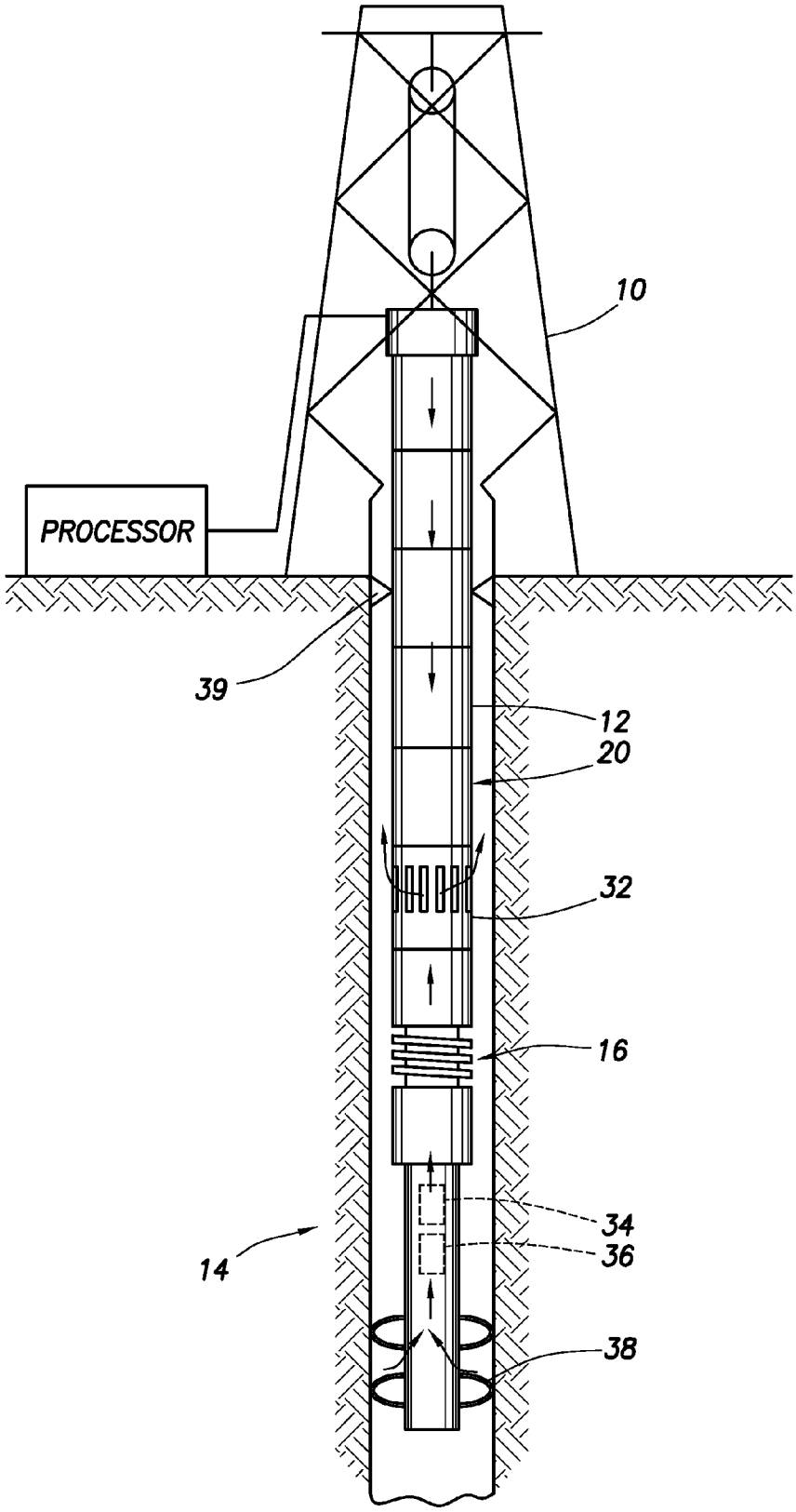
FIG. 1B illustrates an example well site system in an embodiment of the present invention.

In FIGS. 1A and 1B, embodiments of a well site system 100 that may be used to evaluate the wellbore 14, which may be onshore or offshore, are generally shown. The well site system 100 may include a rig 10 for supporting a drill string assembly 20 comprising one or more pipe sections 12 such as drill pipe. The drill string assembly 20 may be a wired drill pipe string. In an embodiment, the drill string assembly 20 may be a tubing string with a wireline cable. A wellbore 14 may be formed by rotation of the drill string assembly 20 and/or a drill bit (not shown). The wellbore 14 extends into the earth below the rig 10. Drilling fluid, such as mud, may be pumped through the drill string assembly 20 for lubricating and cooling downhole tools or maintaining pressure in the wellbore 14, for example.

One or more downhole components 30 may be connected to the drill string assembly 20. For example, the downhole components 30 may be connected to the drill string assembly 20 for measuring characteristics of the drill string assembly 20, formations about the wellbore 14, and/or the wellbore 14. The downhole components 30 may perform sampling and/or analyzing of the wellbore 14 and/or the formation surrounding the wellbore 14. The downhole components 30 may be incorporated into a bottom hole assembly and may be interconnected to provide power and data communication between the downhole components 30. The downhole components 30 may be formation testing tools such as wireline configurable tools, logging-while-drilling tools, measuring-while-drilling tools, or any other tool, sensor, or measuring device.

In an embodiment, the downhole components 30 may be wireline configurable tools, such as tools commonly conveyed by wireline cable. For example, the wireline configurable tool may be a logging tool for sampling or measuring characteristics of the wellbore 14, or formations about the wellbore 14. The wireline configurable tool may make measurements such as gamma radiation measurements, nuclear measurements, and resistivity measurements, for example. The measurements may be utilized to determine density and porosity, among other characteristics, of the wellbore 14 or formations about the wellbore 14. An example of a wireline configurable tool string is discussed in "Advancing Downhole Conveyance" by Alden M. Arif F., Billingham M., Gronnerod N., Harvey S., Richard M. E. and West C., published in Oilfield review 16, no. 3 (autumn 2004): pp 30-43, which is discussed in relation to a tough logging condition system ("TLC") and is hereby incorporated by reference. The downhole components 30 may comprise components for providing data and power communication. For example, the downhole component 30 may comprise a motor, a modulator or other downhole device for use with the drill string assembly 20. The downhole components 30 may also comprise a power electronics unit 34, a pump 36, and packers 38.

Figure 6:
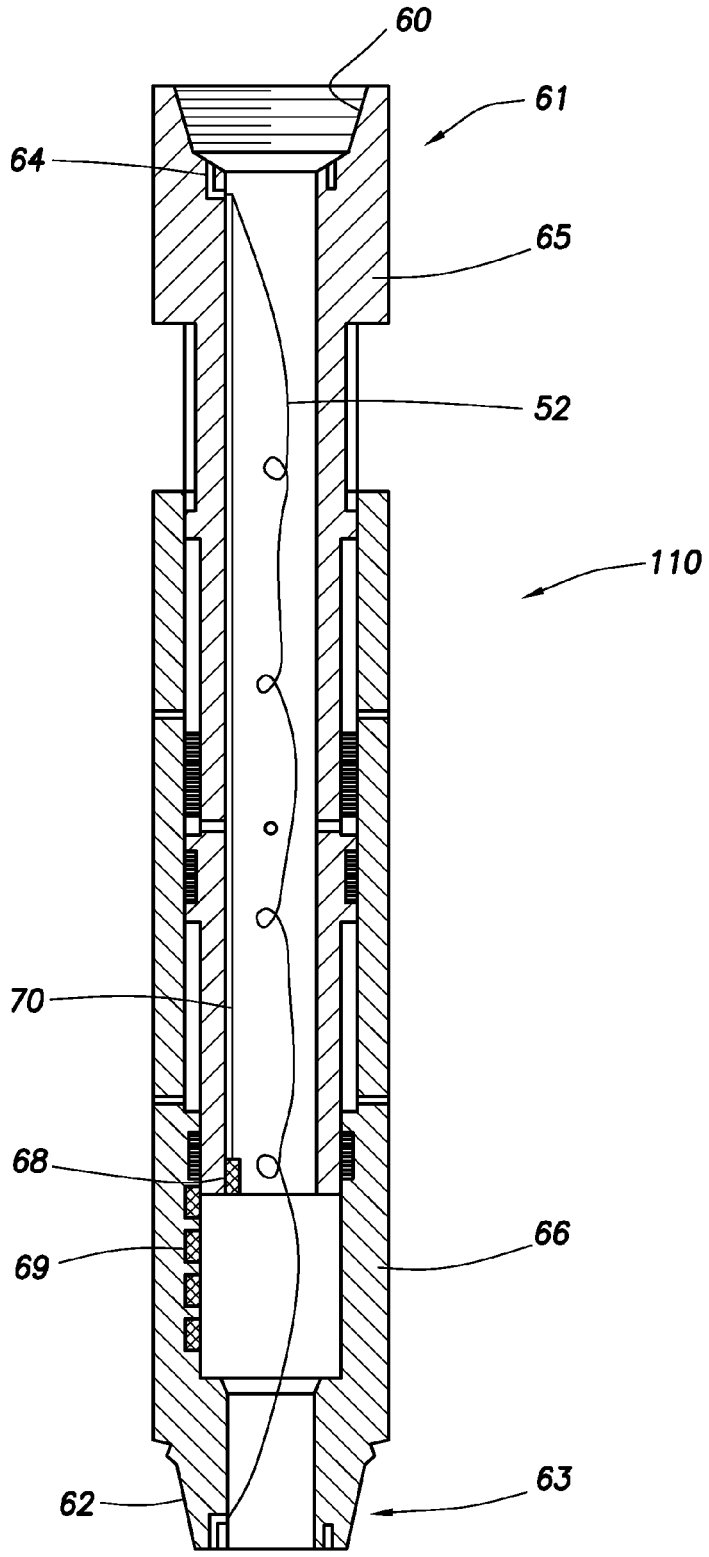
FIG. 6 illustrates a compensated wired slip joint in an embodiment of the present invention.

The well site system 100 is shown as an example of a system in which a wired slip joint 16 may be used, for example a compensated wired slip joint 110, as shown in FIG. 6. The wired slip joint 16 may be coupled between pipe sections 12 of the drill string assembly 20 and/or the downhole components 30. In the embodiments shown in FIGS. 1A and 1B, the wired slip joint 16 may be used between a packer 38 and a blowout preventer (BOP) 39. The packers 38 and BOP 39 may be used to hold portions of the drill string assembly 20 in place while measurements or tests are performed. The wired slip joint 16 may act as an expansion/retraction compensating tool. The wired slip joint 16 may accommodate changes in length of the section of the drill string assembly 20 between the BOP 39 and packers 38 due to changes in temperature and pressure of the drill string assembly 20. For example, when the usually cold drilling assembly 20 is introduced in the usually hot wellbore 14, its temperature will increase. When the usually cold mud is circulated in the drill string assembly 20 from the surface, the temperature of drilling assembly 20 may reduce. When circulation of usually cold mud is stopped, the temperature of the drilling assembly 20 may increase. In this set-up, the mud may prevent sticking between the wellbore 14 and the drilling assembly 20, among other functions.

During the time of testing, drilling fluid may be circulated in the wellbore 14, thereby cooling the well in some cases and possibly inducing length variations of the drill string assembly 20, such as on the order of 1 meter. The wired slip joint 16 provides a way to account for the variation in the length of the drill string assembly 20 during testing. The wired slip joint 16 may have an upper and lower member, one disposed within the other, which translate relative to one another. Lengthening and shortening of the drill string 20 may be accounted for by allowing the wired slip joint 16 to extend and retract in length by allowing translation between the upper and lower members. While the wired slip joint 16 compensates for changes in length of the drill string 20, the BOP 39, and packers 38 may stay in place while tests are performed.

FIGS. 1A and 1B illustrate a drill string assembly 20 having a wired slip joint 16 and a flow diverter, such as circulation vents 32, coupled to an end thereof. The drilling fluid may circulate through the drill string assembly 20, out of the circulation vents 32, and back to the surface. The circulation vents 32 may include a turbine that may be utilized to power downhole tools. The drill string assembly 20 in the present example may be a so-called "wired" pipe string that has associated with each pipe section 12 an electrical signal conductor or associated cable (not shown separately in FIG. 1) for communicating signals from the downhole components 30 to a surface processor, such as for example a data storage device or computer. Non-limiting examples of such wired, threadedly coupled drill pipe are described in U.S. Patent Application Publication No. 2006/0225926 filed by Madhavan et al., the underlying patent application for which is assigned to the assignee of the present invention, and in U.S. Pat. No. 6,641,434 issued to Boyle et al. also assigned to the assignee of the present invention, which are both hereby incorporated by reference. In an embodiment, the drill string assembly 20 may comprise wired drill pipe as well as other telemetry systems, such as wireline.

In FIG. 1A, the wired slip joint 16 may be coupled to the drill string assembly 20 above the circulation vents 32. In FIG. 1B, the wired slip joint 16 may be coupled to the drill string assembly below the circulation vents 32. In an embodiment, the wired slip joint 50 may be used between two packers, for example as shown in U.S. Patent Application Pub. No. 2008/0053652, which is herein incorporated by reference. Arrows indicating the flow paths of drilling fluid and fluid collected from the formation are shown. The drilling fluid may flow down through the drill string assembly 20 and out the circulation vents 32. A portion of the drilling fluid may also flow past the circulation vents 32 to cool and lubricate downhole tools.

The wired slip joint 16 may be utilized in formation testing since formation testing may benefit from data transmitted to the surface in quasi real time. Real time signal transmission may be beneficial for monitoring and making decisions about the test being performed. Commands may also be sent to the tools, for example a command to terminate a test being performed. A formation test or logging operation may, for example, last several hours.

Figure 2A:
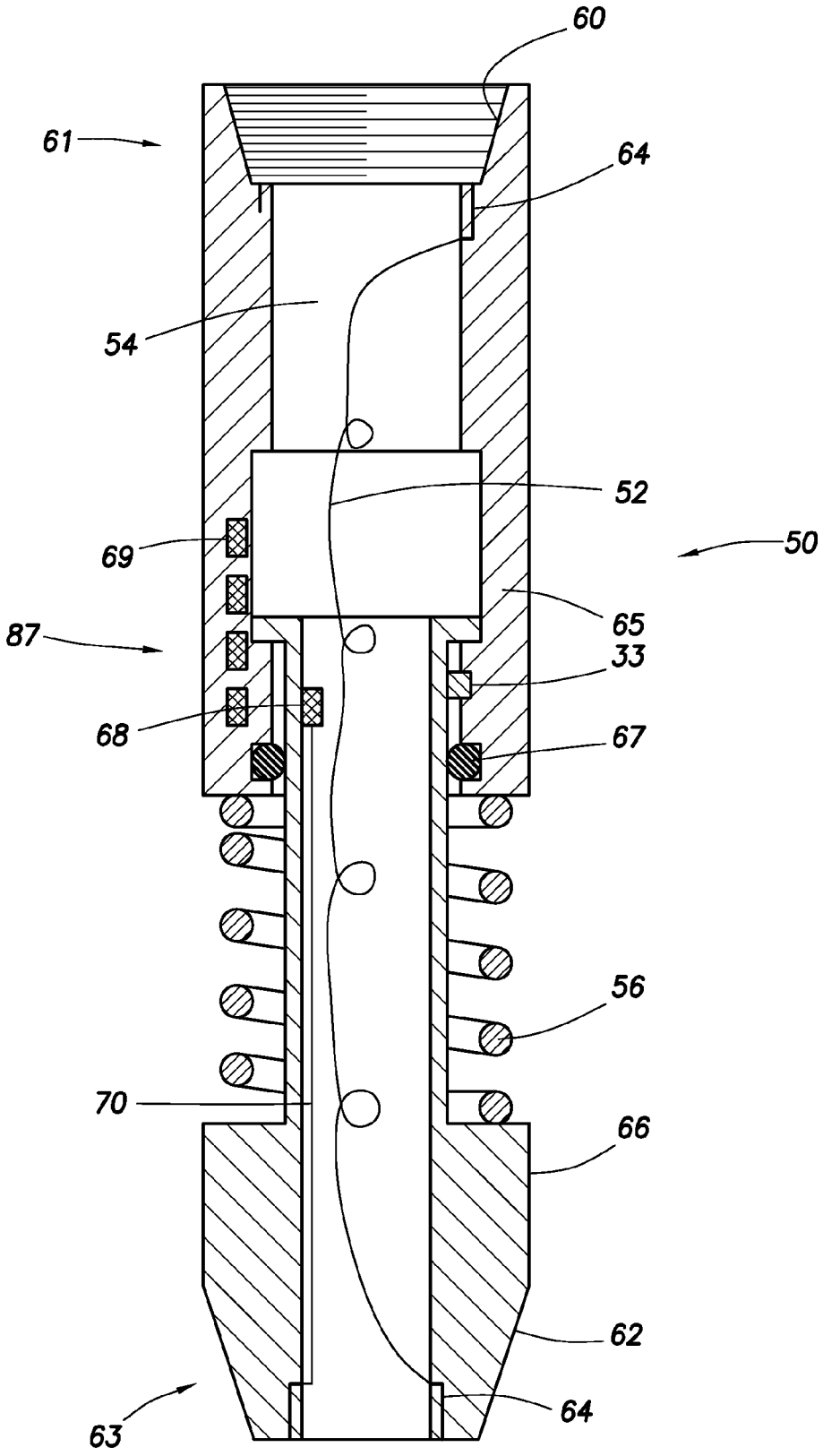
FIG. 2A illustrates a wired slip joint in an embodiment of the present invention.
Figure 2B:
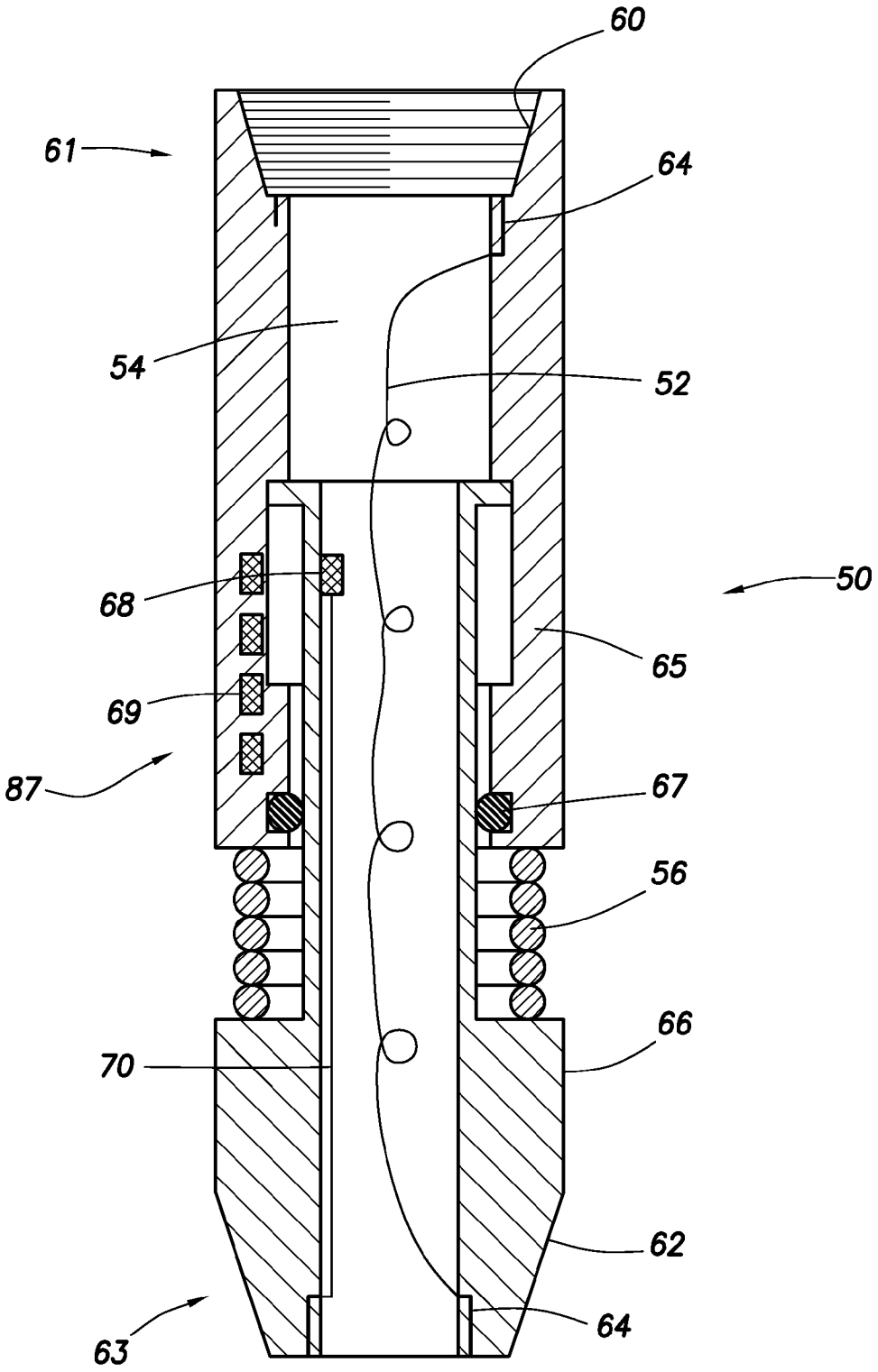
FIG. 2B illustrates the wired slip joint of FIG. 2A in a retracted position in an embodiment of the present invention.
Figure 2C:
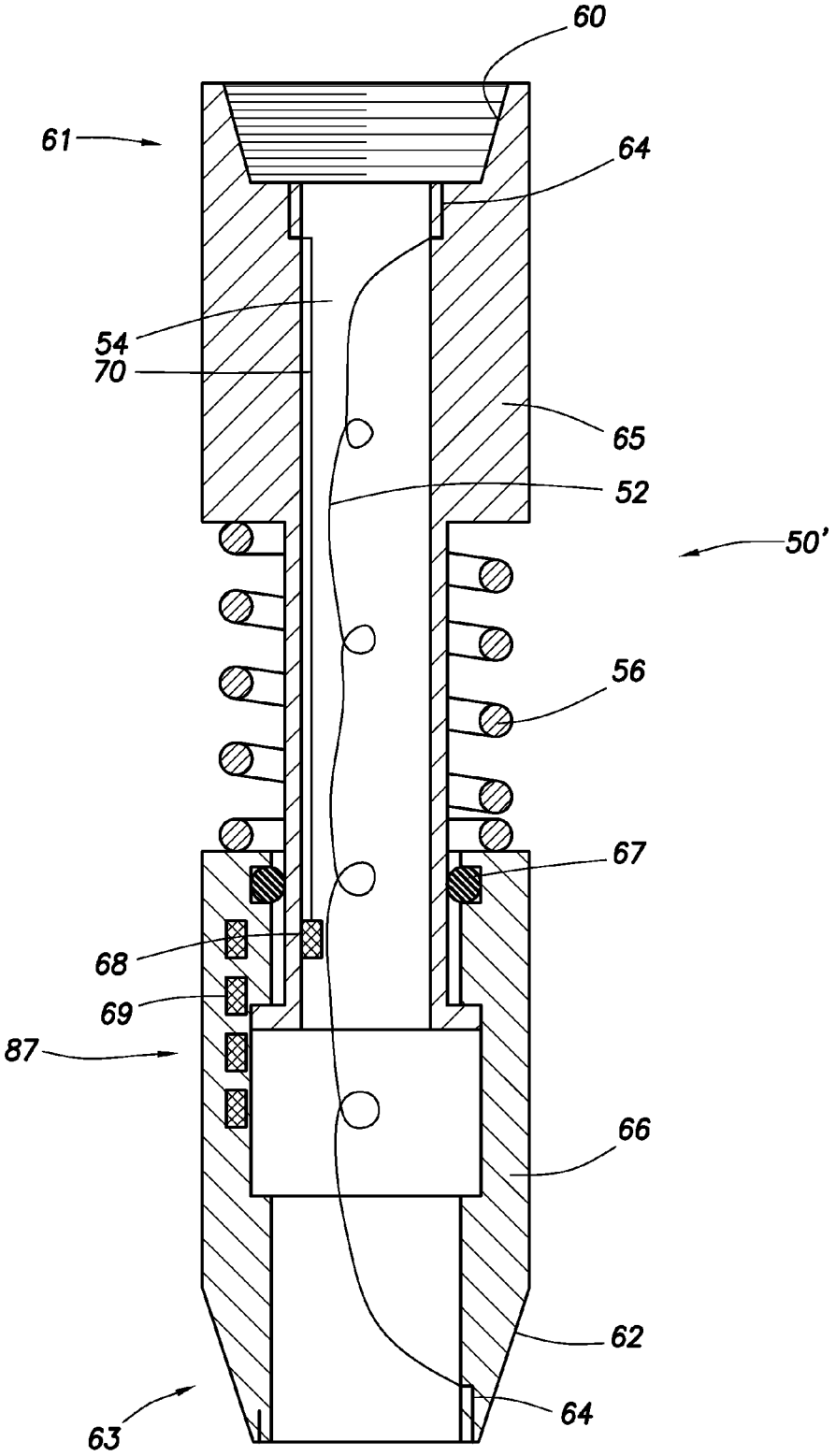
FIG. 2C illustrates a wired slip joint in an embodiment of the present invention.

FIGS. 2A-2C illustrate embodiments of a wired slip joint 50 which may be used on the drill string assembly 20. The wired slip joint 50 may comprise a lower slip joint member 66 having a pin end 63 and an upper slip joint member 65 having a box end 61. Optionally, the wired slip joint 50 may include a key 33 which may prevent rotation of the upper and lower slip joint members 65, 66 relative to one another while still allowing longitudinal translation. The key 33 may slide in a slot (not shown). The box end 61 may have a box connection 60 and the pin end 63 may have a pin end connection 62. The lower slip joint member 66 may be disposed within an annulus of the upper slip joint member 65 at a location opposite the box and pin ends, 61, 63. For example, the lower slip joint member 66 may have a mandrel like portion opposite the pin end 63 that fits inside a sleeve like portion of the upper slip joint member 65 opposite the box end 61. Thus, the upper and lower slip joint members 65, 66 may be telescopically engaged such that one of the joint members moves within the other joint member. An inner passage 54 may be formed between the box end 61 and pin and 63. As the wired slip joint 50 extends and retracts, the inner passage 54 lengthens and shortens respectively. The wired slip joint 50 may move from a retracted position to an extended position having a length greater than the retracted position to compensate for changes in length of the drill string as described previously. In an embodiment, the pin end moves closer to the box end at the retracted position than at the extended position. In an embodiment, the lower slip joint member 66 may translate and/or rotate within an annulus of the upper slip joint member 65, as shown in FIG. 2A. In another embodiment, the upper slip joint member 65 may translate and/or rotate within an annulus of the lower slip joint member 66 such as in wired slip joint 50', as shown in FIG. 2C. Drilling fluid may flow from the surface into the inner passage 54 of the wired slip joint 50 and pass on to other components of the drill string assembly 20.

Figure 3A:
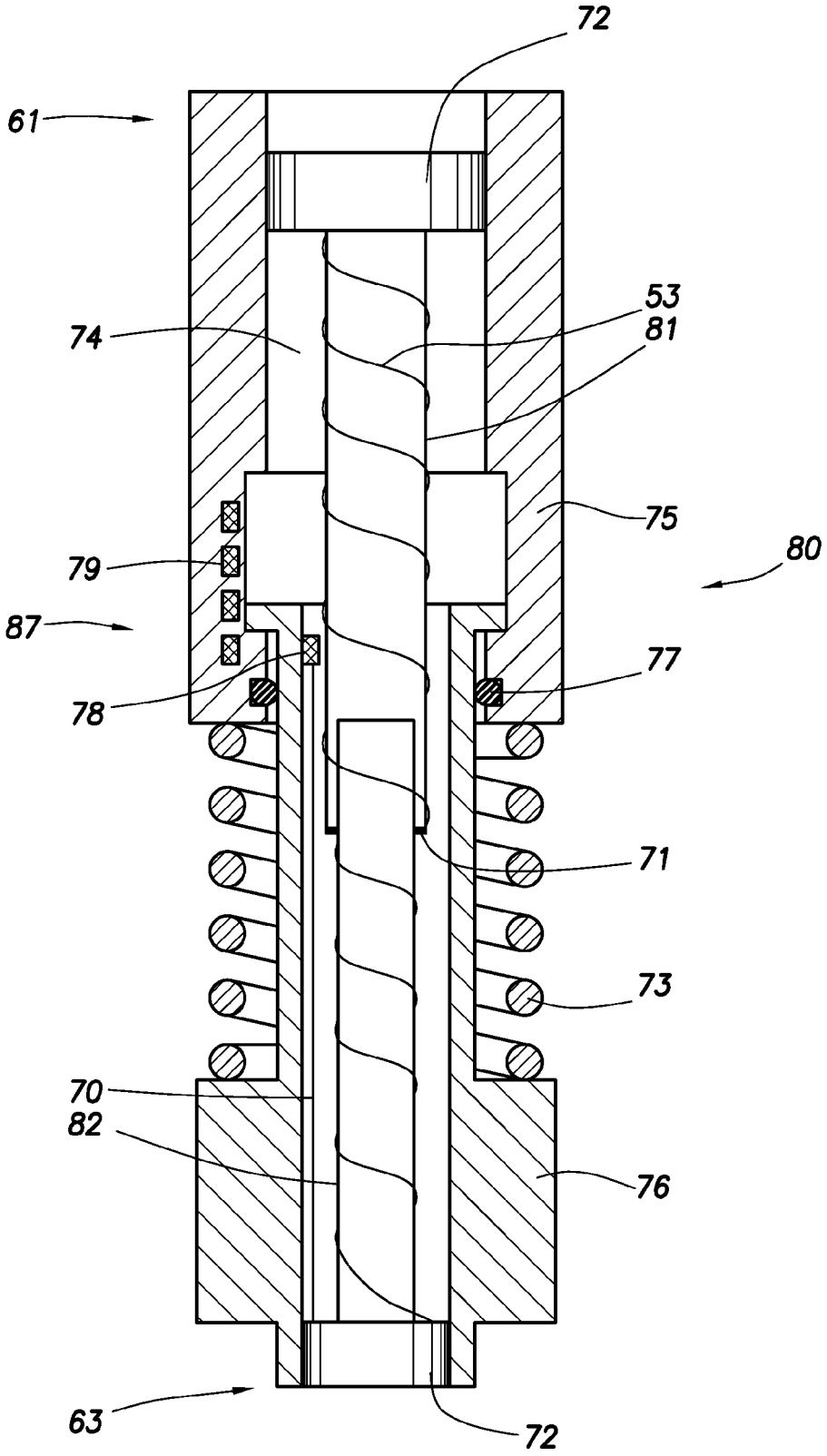
FIG. 3A illustrates a wired slip joint in an embodiment of the present invention.
Figure 3B:
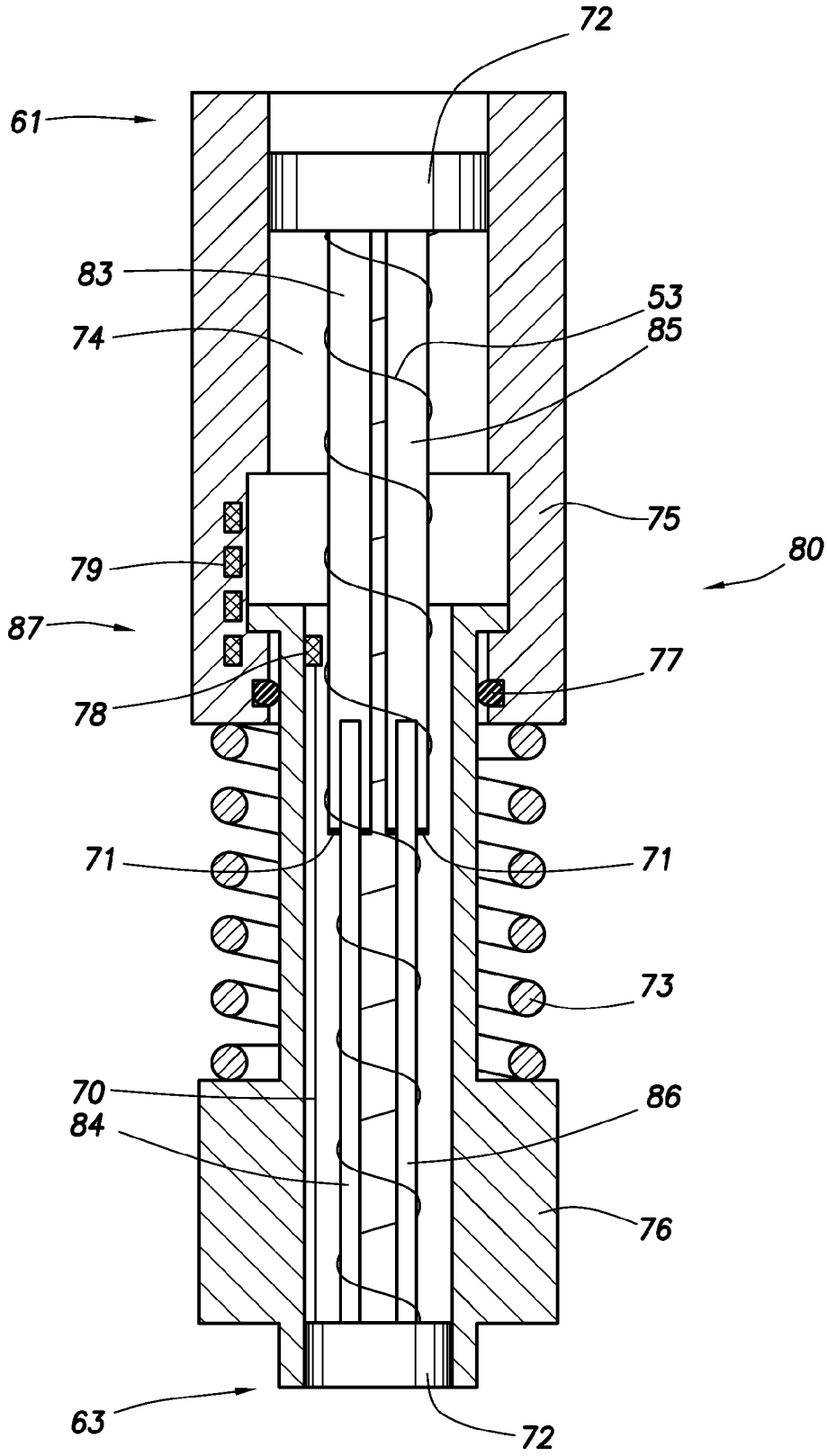
FIG. 3B illustrates a wired slip joint in an embodiment of the present invention.
Figure 5:
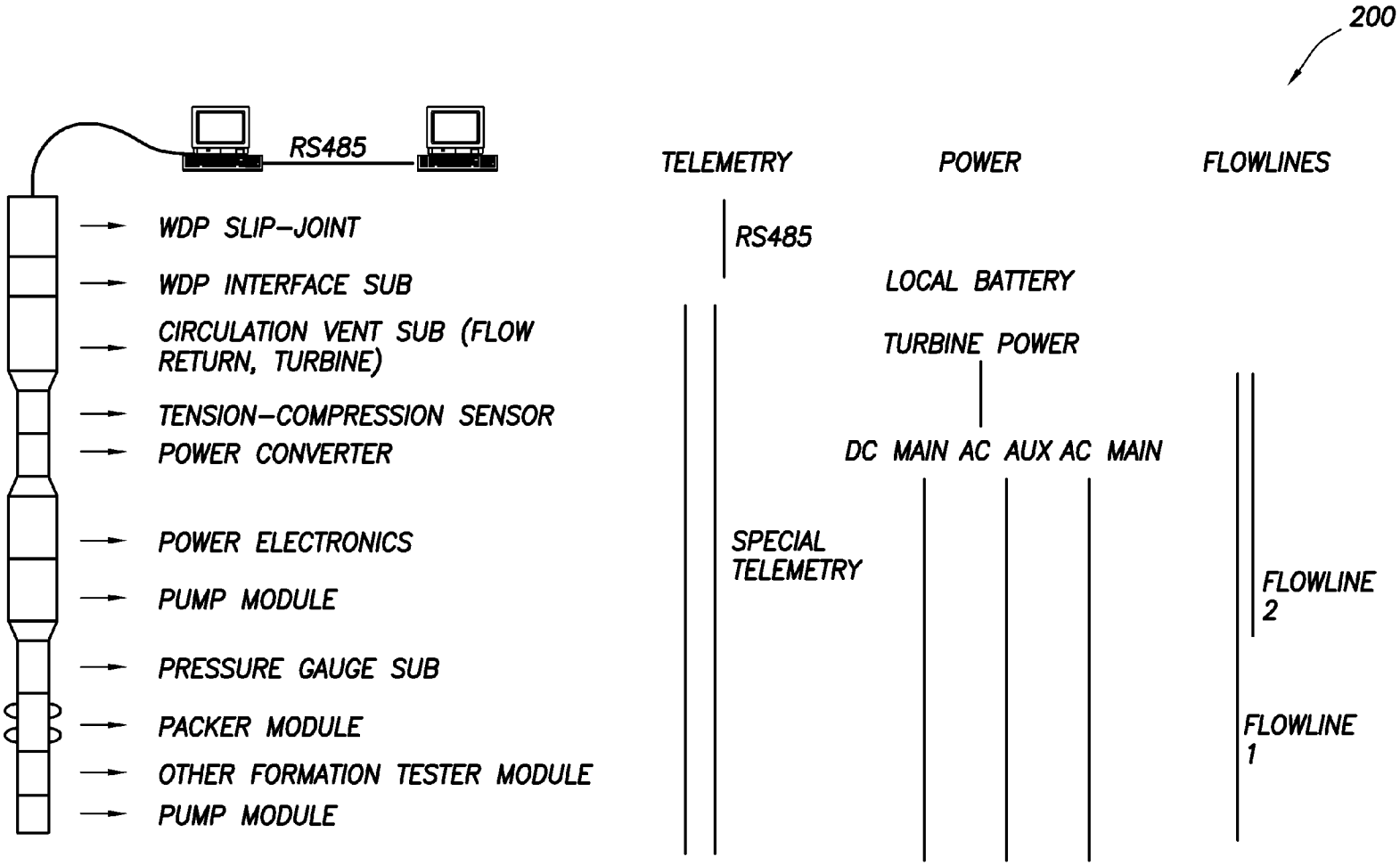
FIG. 5 illustrates a tool string architecture in an embodiment of the present invention.

The communication elements 64 may be configured to couple with communication elements (not shown) of the drill string assembly 20 in order to transmit signals, data, and/or power between the surface and other components of the drill string assembly 20. Some examples of communication elements include inductive couplers, non-toroidal inductive couplers, flux couplers, direct connect couplers, or any component for transmitting data across tool joints. An example of an inductive coupler can be found in U.S. Patent Application Pub. No. 2007/0029112, which is hereby incorporated by reference. The communication elements 64 may also include wireline connectors and wet connectors such as hydraulic and electric connectors, such as shown in FIGS. 3A, 3B, and 5.

A spring 56 surrounds the mandrel like portion. The spring 56 may provide a compressive or tensile force between the upper and lower slip joint members 65, 66 depending on the relative distance in translation between the upper and lower slip joint members 65, 66. The spring 56 may further assist in retaining the lower slip joint member 66 within the upper slip joint member 65. A seal 67 surrounds the mandrel like portion to prevent fluid leakage from the inner passage to the well bore and vice versa. The seal 67 creates a seal between an outer surface of the lower slip joint member 66 and an inner surface of the upper slip joint member 65.

A coiled cable 52 may be coupled with box end and pin end communication elements 64 disposed proximate the box end and pin end. The coiled cable 52 may comprise an insulated electric/metallic wire or a plurality of electrically insulated wires within a protective tubular casing. In another embodiment, the coiled cable 52 may include a single coaxial cable within a tubular housing. The coiled cable 52 may have ends coupled to the communication elements 64 of the upper slip joint member 65 and lower slip joint member 66. In an embodiment, the coiled cable 52 traverses the inner passage 54 and is immersed in fluid flowing through the inner passage 54. The coiled cable 52 may be configured to transmit data and/or power. The coiled cable 52 may also be configured to uncoil and/or recoil with longitudinal movements between the upper slip joint member 65 and lower slip joint member 66. The wired slip joint 50 is shown in an extended position in FIG. 2A and the coiled cable 52 is shown in a partially uncoiled position. The extended position of the wired slip joint member 50 may occur when the wired slip joint 50 lengthens due to the upper and lower slip joint members 65, 66 having been longitudinally displaced relative to one another. The wired slip joint 50 is shown in a retracted position in FIG. 2B and the coiled cable 52 is shown in a recoiled position.

At least one sensor system 87 may be disposed along the upper or lower slip joint members 65, 66. The sensor system 87 measures a position from the expanded position to a retracted position of the wired slip joint 50. In other words, the sensor system 87 detects a change in length of the slip joint 50 and generates a signal representative of a position of the slip joint 50 that may be transmitted from the slip joint 50 to the well bore surface, such as to a surface processor, through a communication system. The sensor 68 of the sensor system 87 may be electrically coupled with at least one of the box end and pin end communication elements 64 and have a battery (not shown) for powering the sensor. The sensor system 87 may comprise at least one sensor 68, and one or more sensor trips 69. The sensor 68 may be any type of sensor, such as for example a magnetic, conductive, or sonic sensor. The sensor trips 69 may be made of a material that the sensor 68 detects. For example, if the sensor 68 is a magnetic sensor, then the sensor trips 69 may be made of a magnetic material. In an embodiment, the sensor 68 comprises a Hall Effect sensor and the plurality of sensor trips 69 comprises magnets. The sensor 68 may be coupled to the communication element 64 within the lower slip joint member 66.

The sensor trips 69 may create a variation from a baseline of a parameter of the signal sent from the sensor 68 which may indicate the longitudinal position between the upper and lower slip joint members 65, 66. The variation may be a variation in frequency, magnitude, or other such signal parameter. The sensor trips 69 may also affect the sensor signals differently, which may further indicate the longitudinal position between the upper and lower slip joint members 65, 66. For example, the sensor trips 69 may increasingly alter a parameter of the sensor signal as the sensor 68 passes successive sensor trips 69. Thus, an amount of extension and/or retraction of the wired slip joint 50 may be determined by the sensor system 87 during extension and/or retraction of the wired slip joint 50. The sensor 68 may be positioned on one of the upper slip joint member 65 and the lower slip joint member 66, the sensor 68 detecting sensor trips 69 moving adjacent to the sensor 65 wherein the sensor trips 69 are positioned on the upper slip joint member 65 or the lower slip joint member 69 not having the sensor positioned thereon. In an embodiment the sensor 68 may be disposed on an inner diameter of the lower slip joint member 66 and the one or more sensor trips 69 may be disposed along an inner diameter of the upper slip joint member 65 at predetermined intervals. A thickness of the lower slip joint member 66 thereby separates the sensor 68 from the sensor trips 69. The separation between the sensor 68 and sensor trips 69 may not affect the ability of the sensor 68 to sense the sensor trips 69. The separation may also protect the sensor 68 from wear caused by rubbing or contacting surfaces of the upper slip joint member 65.

FIGS. 3A and 3B illustrate embodiments of a wired slip joint 80 which may be used on the drill string assembly 20. In an embodiment, the wired slip joint 80 may be positioned between the pump 36 and the circulation vents 32 shown in FIGS. 1A and 1B. The wired slip joint 80 may comprise an upper slip joint member 75, a lower slip joint member 76, a spring 73, hydraulic and electric connectors 72, a seal 77, a flow line including an upper flow line 81 and a lower flow line 82, a seal 71, a sensor 78, and one or more sensor trips 79. The upper slip joint member 75 and the lower slip joint member 76 may be coupled by the spring 73. The upper and lower slip joint members 75, 76 may include a hydraulic and electric connector 72, for example as described in Patent Application Pub. No. 2009/0025926, which is hereby incorporated by reference. The lower slip joint member 76 may translate and/or rotate within an annulus of the upper slip joint member 75. The seal 77 creates a seal between an outer surface of the lower slip joint member 76 and an inner surface of the upper slip joint member 75. The spring 73 may provide a compressive or tensile force between the upper and lower slip joint members 75, 76 depending on the relative distance in translation between the upper and lower slip joint members 75, 76. The spring 73 may further assist in retaining the lower slip joint member 76 within the upper slip joint member 75.

The flow line including the upper and lower flow lines 81, 82 traverses a volume 74 between the box end 61 with the pin end 63. Formation fluid from a reservoir may be transported upward through the slip joint via the flow line. In an embodiment, the drilling fluid may be transported downward through the slip joint via the flow line. The coiled cable 53 may be wrapped around the upper and lower flow lines 81, 82 and have ends coupled to the hydraulic and electric connectors 72 of the upper slip joint member 75 and lower slip joint member 76. The coiled cable 53 may be protected from fluid flowing through the upper and lower flow lines 81, 82. The coiled cable 53 may be configured to transmit data and/or power and may also be configured to uncoil and/or recoil with longitudinal movements between the upper slip joint member 75 and lower slip joint member 76.

The wired slip joint 80 is shown in an extended position in FIGS. 3A and 3B and the coiled cable 53 is shown in an uncoiled position. The lower flow line 82 may translate and/or rotate within an annulus of the upper flow line 81. The seal 71 creates a seal between an outer surface of the lower flow line 82 and an inner surface of the upper flow line 82. The upper and lower flow lines 81, 82 may be coupled with the hydraulic and electric connectors 72 which may have a passage therethrough. The upper and lower flow lines 81, 82 may create a flow path for drilling fluid to flow through. The upper and lower flow lines 81, 82 may also protect the coiled cable 53 from the drilling fluids. In an embodiment, the volume 74 between the upper and lower flow lines 81, 82 and upper and lower slip joint members 75, 76 may be filled with hydraulic oil or simply air. A compensator (not shown) may be coupled to the wired slip joint 80 which may account for pressure changes of the oil within the volume 74 when the wired slip joint 80 extends and retracts. The sensor system 87 may be utilized to determine the extent to which the slip joint 80 is extended or retracted as described above.

In the embodiments shown in FIG. 3B, multiple flow paths may be utilized in wired slip joint 80. A first flow line including upper flow line 83 and lower flow line 84 may create a first flow path, and a second flow line including upper flow line 85 and lower flow line 86 may create a second flow path. In an embodiment, the first flow path may be used to transport formation fluid gathered during a formation test while the second flow path may transport drilling fluid to cool a downhole tool. The formation fluid may be pumped using the pump 36 through the wired slip joint 80 shown in FIG. 3B towards the circulation vents 32. The drilling fluid flows through the drill string assembly 20 until it exits the circulation vents 32. The drilling fluid may flow from 1 to 10 liters per minute, for example, although other flow rates are possible. Formation fluid obtained during testing may flow through drill string assembly 20 to the circulation vents 32. The Formation fluid may flow from 1 to 10 liters per minute, for example, although other flow rates are possible. In an embodiment, the volume 74 between the upper and lower flow lines 83-86 and upper and lower slip joint members 75, 76 may be filled with oil. A compensator (not shown) may be coupled to the wired slip joint 80 which may account for pressure changes of the oil within the volume 74 when the wired slip joint 80 extends and retracts.

Figure 4:
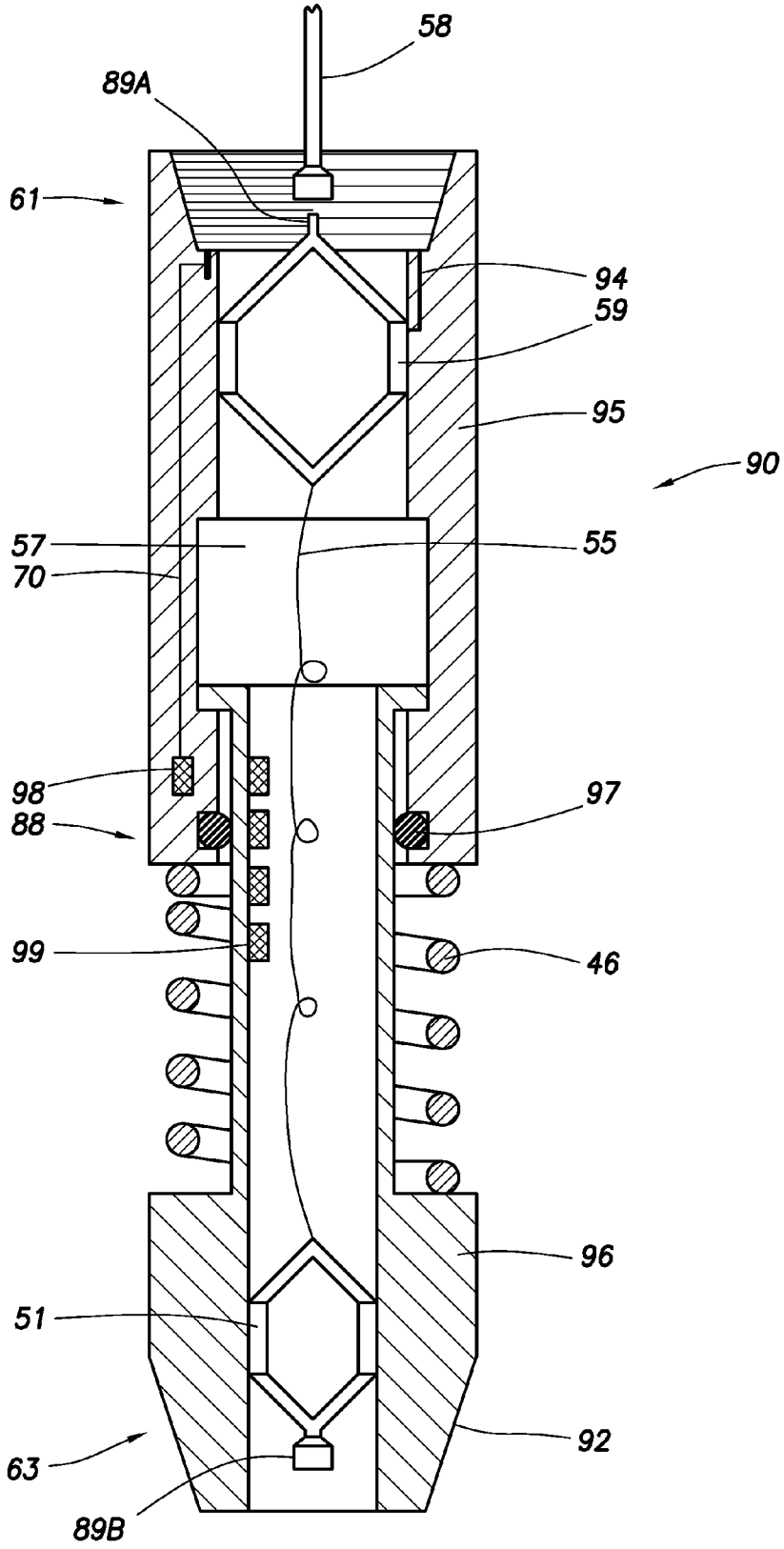
FIG. 4 illustrates a wired slip joint in an embodiment of the present invention.

FIG. 4 illustrates embodiments of a wired slip joint 90 which may be used on the drill string assembly 20. The wired slip joint 90 may comprise a box connection 91, pin connection 92, an upper slip joint member 95, a lower slip joint member 96, a spring 46, an inner passage 57, a coiled cable 55, a communication element 94, a seal 97, an upper wireline connector 59, a lower wireline connector 51, a sensor 98, and one or more sensor trips 99. The lower slip joint member 96 may translate and/or rotate within an annulus of the upper slip joint member 95. The seal 97 creates a seal between an outer surface of the lower slip joint member 96 and an inner surface of the upper slip joint member 95. The spring 46 may provide a compressive or tensile force between the upper and lower slip joint members 95, 96 depending on the relative distance in translation between the upper and lower slip joint members 95, 96. The spring 46 may further assist in retaining the lower slip joint member 96 within the upper slip joint member 95.

The upper wireline connector 59 may be coupled to the upper slip joint member 95 while the lower wireline connector 51 may be coupled with the lower slip joint member 96. The upper wireline connector 59 may include a wet connect 89A configured to engage the wireline cable 58. In an embodiment, the wires connected to the communication element 94 (data communication wires) and the wire connected to the wireline cable 58 (electrical power wire and/or data communication wires) in the upper slip joint member 95 may be bundled together into a coiled bundle that runs through the wired slip joint 90. The other end of the coiled bundle may be connected to a multi-pin LWD type connector 89B adjacent the lower slip joint member 96, for example as described in U.S. Patent Application Pub. No. 2006/0283606, which is hereby incorporated by reference.

Data communication may be provided between the downhole tools 30 and the surface by two redundant paths. In an embodiment, one communication path may be through the communication element 94 and the drill string assembly 20. The communication element 94 may be communicatively coupled with the upper wireline connector 59. In case the communication path of the drill string assembly 20 fails from a failed component within a pipe section 12 that is above the wired slip joint 90, a wireline cable 58, i.e. a second communication path, may be pumped into the pipe bore and may be used to reestablish data communication by coupling the wireline 58 to the upper wireline connector 59. For example, a wireline cable may be pumped into the pipe bore and may be used to reestablish data communication, as usual in TLC operations.

In an embodiment, the wireline 58 may be used as the main communication path while the communication path within the drill string assembly 20 may act as a redundant path. The lower wireline connector 51 may be adapted to couple with a connector (not shown) of a wireline configurable tool (not shown) or with a wireline (not shown) within the drill string assembly 20 or downhole tools. Thus, in some embodiments of the invention, the communications system along the drill string 20 may comprise a wireline cable that can transmit bidirectional data and power between the well bore tools of the drill string assembly 20 and the well bore surface. In other embodiments, the communications system may comprise wired drill pipe that transmits bidirectional data and power between the well bore tools of the drill string assembly 20 and the well bore. In some embodiments, a combination of wireline and wired drill pipe may be used as the communications system. Thus, data communication may be provided between the downhole tools and the well bore surface and through the wired slip joint 90 by two redundant paths.

Fluid may flow through the upper wireline connector 59, into the inner passage 57, and then through the lower wireline connector 51. The coiled cable 55 may have ends coupled to the upper and lower wireline connectors 59, 51. The coiled cable 55 may be configured to transmit data and/or power and may also be configured to uncoil and/or recoil with longitudinal movements between the upper slip joint member 95 and lower slip joint member 96. The wired slip joint 90 is shown in an extended position in FIG. 4 and the coiled cable 55 is shown in an uncoiled position. The communication element 94 may be configured to couple with communication elements (not shown) of the drill string assembly 20 in order to transmit data and/or power between the surface and other components of the drill string assembly 20. Drilling fluid may flow from the surface into the inner passage 57 of the wired slip joint 90 and pass on to other components of the drill string assembly 20.

In an embodiment, a sensor system 88 may be utilized to determine the extent to which the slip joint 90 is extended or retracted. The sensor system 88 operates similar to the sensor system 87 except that the sensor trips 99 may be coupled to the lower slip joint member 96 while the sensor 98 may be coupled to the upper slip joint member 95. The sensor 98 may be coupled to the communication element 94 within the upper slip joint member 95.

Embodiments of a system architecture 200 shown in FIG. 5 may include a bottom pump module connected to a flowline (flow line 1). The bottom pump out may be used to inflate/deflate the packers of the packer module. The bottom pump out can also be used to pump formation fluid from the interval between the packers on the packer module, and/or capture samples in containers located in the "other formation tester modules". The system architecture 200 may also include "other formation tester modules", such as fluid analysis modules, sample container carrier, etc. Descriptions of known modules can be found in U.S. Pat. No. 4,860,581, which is hereby incorporated by reference. The tool string architecture 200 may further include a packer module, having at least one inlet. The inlet may selectively be connected to the flowline 1 and/or the flowline 2, for example.

The pressure gauge sub may comprise a high resolution pressure gauge in pressure communication with the flowline 1 or the flowline 2. A second pump module may be provided to pump fluid from the packer interval into the flowline 2. The power converter and the power electronics may be used to convert the electrical power provided by a turbine into power lines that can run through the wireline tool assembly, for example AC and DC power lines. A tension compression sensor may be used below the wired slip joint to control proper operation of the wired slip joint, and more specifically to insure that no excessive tension or compression is transmitted from the pipe to the downhole tools below the wired slip joint.

The circulation vent sub may include a turbine to generate power for the downhole tools, as well as one or more exit ports for flowlines 1 and 2. The WDP interface sub may be used to convert the special telemetry used along the tool string into RS 485 telemetry protocol. Also, the WDP interface sub may drive inductance couplers connected to the end on the WDP. The tool string architecture 200 may be used to perform well tests.

Embodiments of the invention may also include a method of communicating with downhole tools, such as wireline tools, LWD tools, MWD tools, slip joints, and other tools as previously discussed. The method may include deploying a drill string assembly in a well bore such as illustrated in FIGS. 1A and 1B. A slip joint is positioned in the drill string, the slip joint having communication connectors at opposing ends connected by a wire, the communication connectors cable of transmitting data to a communications system. The slip joint comprises an upper portion and a lower portion telescopically connected and movable between a range of positioned from a retracted position to an extended position, the slip joint having a length at the retracted position less than a length at the extended position. The method includes determining the length of the slip joint and transmitting a slip joint position signal through the communications system to the well bore surface such as previously described.

In an embodiment, the slip joint has a sensor positioned on one of the upper portion and the lower portion of the slip joint, and wherein the slip joint has a plurality of sensor trips positioned at predetermined intervals on the other one of the upper portion or the lower portion, the sensor trips detectable by the sensor to determine the length of the slip joint as previously described. The method may include transporting formation fluid upward through the slip joint through a flow line extending within the upper portion and the lower portion and fluidly isolated from the interior of the slip joint. In an embodiment of the method, the communication system comprises a plurality of wired drill pipes and the slip joint has inductive couplers positioned at opposing ends of the upper portion and the lower portion to communicate with the plurality of wired drill pipes, and further wherein the wire extends between and electrically connects the inductive couplers. In an embodiment, the wire is coiled around the flow line.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A system comprising:

a drill string assembly comprising a plurality of pipe joints;

a slip joint coupled to the plurality of pipe joints, the slip joint movable from a retracted position to an extended position to compensate for changes in length of the drill string, the extended position having a length greater than the retracted position; wherein the slip joint comprises:

a lower slip joint member having a pin end;

an upper slip joint member having a box end, the lower slip joint member telescopically engaged with the upper slip joint such that one of the joint members moves within the other joint member, thereby forming an expandable and contractible inner passage between the box end and the pin end; and a coiled cable coupled with a box end communications element disposed proximate the box end and a pin end communications element disposed proximate the pin end, the box and pin end communications element electrically coupled to a communication system;

a sensor positioned in the slip joint, wherein the sensor detects a change in length of the slip joint and generates a signal representative of a position of the slip joint wherein the sensor is disposed along the upper slip joint member or the lower slip joint member and is electrically coupled with at least one of the box end and pin end communications elements; and the communication system to transmit the signal from the slip joint to a surface processor.

2. The system of claim 1, wherein the communication system comprises at least one of a plurality of wired drill pipes and wireline cable.

3. The system of claim 1, further comprises a plurality of sensor trips detectable by the sensor to determine a position of the slip joint.

4. The system of claim 3, wherein the sensor is disposed on an inner diameter of the lower slip joint member and the plurality of sensor trips are disposed along an inner diameter of the upper slip joint member at predetermined intervals, such that an amount of extension or retraction of the slip joint is determined.

5. The system of claim 1, further comprising at least one flow line traversing the slip joint for transporting formation fluid from a reservoir upward through the slip joint.

6. The system of claim 1, wherein the coiled cable traverses the inner passage, such that the coiled cable is immersed in fluid flowing through the inner passage.

7. A slip joint, comprising:

a lower slip joint member having a pin end connectable to a drill pipe;

an upper slip joint member having a box end, the lower slip joint member telescopically coupled with the upper slip joint member to form an expandable and contractible inner passage between the box end and the pin end, wherein the lower slip joint member and the upper slip joint member are movable from a retracted position to an extended position, the pin end closer to the box end at the retracted position than at the extended position;

a wire coupled with a box end communication element disposed proximate the box end and a pin end communication element disposed proximate the pin end, the communication elements capable of transmitting data; and, a flow line extending within the body of the upper slip joint member and the lower slip joint member, the flow line telescopically formed by the connection of the upper slip joint member and the lower slip joint member, wherein the flow line carries formation fluid upward through the slip joint.

8. The wired slip joint of claim 7, further comprising a sensor positioned on one of the upper slip joint member and the lower slip joint member, the sensor detecting sensor trips moving adjacent to the sensor wherein the sensor trips are positioned on the upper slip joint member or the lower slip joint member not having the sensor positioned thereon.

9. The wired slip joint of claim 8, wherein the sensor is disposed on an inner diameter of the lower slip joint member and the sensor trips are disposed along an inner diameter of the upper slip joint member at predetermined intervals, such that an amount of extension or retraction of the slip joint is determined by the sensor detecting at least one of the sensor trips movement of the slip joint from the retracted position to the extended position.

10. The wired slip joint of claim 7, wherein the wire is coiled and positioned around the flow line.

11. The wired slip joint of claim 7, further comprising a second flow line traversing the inner passage, the second flow line transporting drilling mud downward through the slip joint.

12. The wired slip joint of claim 11, wherein the wire surrounds the outside of the flow line or the second flow line, such that the wire is not exposed to fluid flowing through the slip joint.

13. The wired slip joint of claim 7, wherein the wire traverses the inner passage such that the wire is immersed in fluid flowing through the inner passage.

14. The wired slip joint of claim 7, wherein the communication elements comprise at least one of a wireline connector, an inductive coupler, a direct connect coupler, a flux coupler, and non-toroidal inductive couplers.

15. A method of communicating with a downhole tool, comprising:

deploying a drill string assembly in a well bore, the drill string assembly comprising a plurality of pipe joints, a communications system comprising at least one of a plurality of wired drill pipe and a wireline cable;

positioning a slip joint in the drill string, the slip joint having communication connectors at opposing ends connected by a wire, the communication connectors capable of transmitting data to the communications system, wherein the slip joint is comprised of an upper portion and a lower portion telescopically connected and movable between a range of positions from a retracted position to an extended position, the slip joint having a length at the retracted position less than a length at the extended position;

determining the length of the slip joint; and transmitting a slip joint position signal through the communications system to the well bore surface.

16. The method of claim 15 wherein the slip joint has a sensor positioned on one of the upper portion and the lower portion of the slip joint, and further wherein the slip joint has a plurality of sensor trips positioned at predetermined intervals on the other one of the upper portion or the lower portion, the sensor trips detectable by the sensor to determine the length of the slip joint.

17. The method of claim 15 further comprising transporting formation fluid upward through the slip joint through a flow line extending within the upper portion and the lower portion and fluidly isolated from the interior of the slip joint.

18. The method of claim 15 wherein the communication system comprises a plurality of wired drill pipes and the slip joint has inductive couplers positioned at opposing ends of the upper portion and the lower portion to communicate with the plurality of wired drill pipes, and further wherein the wire extends between and electrically connects the inductive couplers.

19. The method of claim 17 wherein the wire is coiled around the flow line.

* * * * *